US010048005B2

(12) United States Patent
Kerschbaum

(10) Patent No.: US 10,048,005 B2
(45) Date of Patent: Aug. 14, 2018

(54) BRICK LINKAGE SYSTEM

(71) Applicant: REFRACTORY INTELLECTUAL PROPERTY GMBH & CO. KG, Vienna (AT)

(72) Inventor: Harald Kerschbaum, Müllendorf (AT)

(73) Assignee: REFRACTORY INTELLECTUAL PROPERTY GMBH & CO. KG, Vienna (AT)

( * ) Notice: Subject to any disclaimer, the term of this patent is extended or adjusted under 35 U.S.C. 154(b) by 373 days.

(21) Appl. No.: 14/770,392

(22) PCT Filed: Feb. 26, 2014

(86) PCT No.: PCT/EP2014/053769
§ 371 (c)(1),
(2) Date: Aug. 25, 2015

(87) PCT Pub. No.: WO2014/173563
PCT Pub. Date: Oct. 30, 2014

(65) Prior Publication Data

US 2016/0003544 A1 Jan. 7, 2016

(30) Foreign Application Priority Data

Apr. 26, 2013 (EP) ..... 13165469

(51) Int. Cl.

| | |
|---|---|
| ***F27D 1/02*** | (2006.01) |
| ***E04C 3/02*** | (2006.01) |
| ***F27D 1/04*** | (2006.01) |
| ***E04B 2/02*** | (2006.01) |

(52) U.S. Cl.
CPC ..... *F27D 1/025* (2013.01); *E04C 3/02* (2013.01); *F27D 1/04* (2013.01); *E04B 2002/0265* (2013.01)

(58) Field of Classification Search
CPC ... F27D 1/02; F27D 1/025; F27D 1/04; F27D 1/0006; F23M 5/00; F23M 5/02; F23M 5/06
USPC ..... 110/331, 334, 338
See application file for complete search history.

(56) References Cited

U.S. PATENT DOCUMENTS

| | | | | |
|---|---|---|---|---|
| 1,874,321 A * | 8/1932 | Longenecker | F27D 1/021 | 110/335 |
| 2,319,065 A * | 5/1943 | Karmanocky | F27D 1/00 | 432/252 |
| 3,171,370 A * | 3/1965 | Fay | F23M 5/06 | 110/335 |
| 4,367,615 A * | 1/1983 | Feldman | E04B 2/18 | 52/591.1 |
| 5,277,580 A * | 1/1994 | Miskolczi, Jr. | F27D 1/04 | 110/336 |
| 6,705,243 B2 * | 3/2004 | Kassau | E04C 3/02 | 110/331 |

(Continued)

FOREIGN PATENT DOCUMENTS

DE 481676 C 8/1929

OTHER PUBLICATIONS

International Search Report for App. No. PCT/EP2014/053769 dated May 9, 2014.

*Primary Examiner* — David J Laux
(74) *Attorney, Agent, or Firm* — Walker & Jocke

(57) ABSTRACT

The invention relates to a set (array) of refractory ceramic bricks for the formation of a vault-like (arch-like) support structure.

12 Claims, 2 Drawing Sheets

(56) References Cited

U.S. PATENT DOCUMENTS

Figure 3:
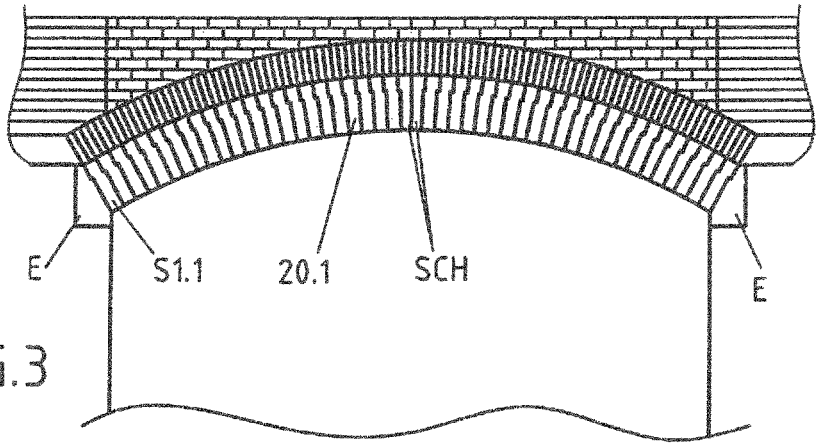

2004/0140598 A1* 7/2004 Takahashi ..... C21C 5/44
266/283

* cited by examiner

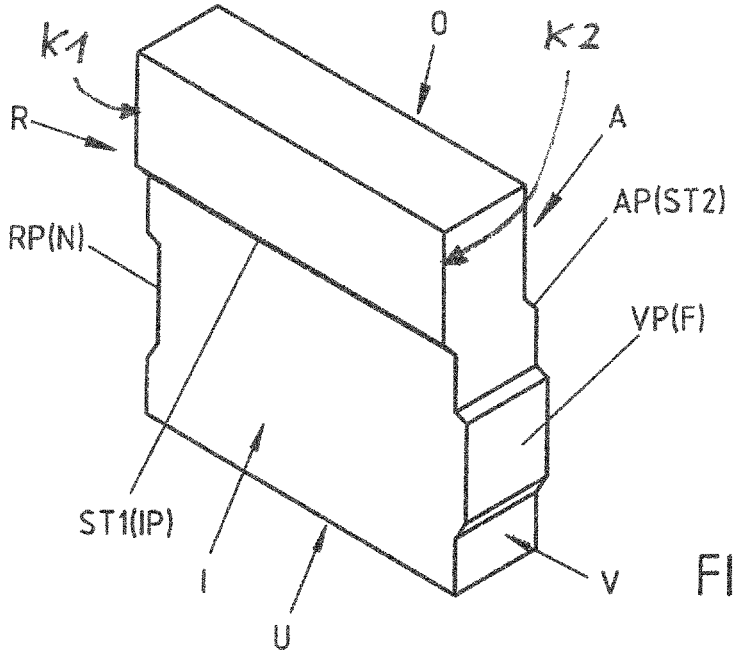
FIG.1
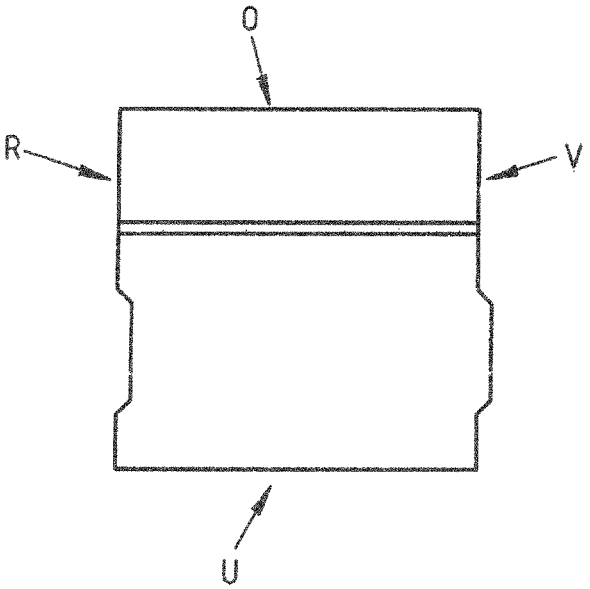
FIG.2b
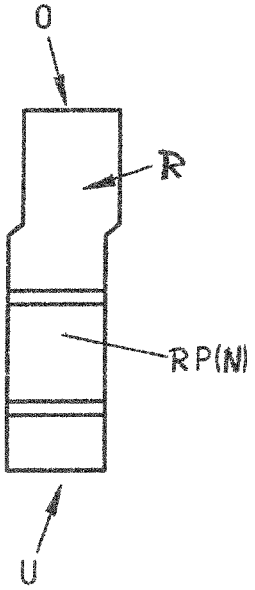
FIG.2a
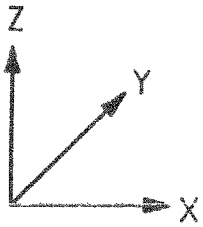

BRICK LINKAGE SYSTEM

The invention relates to a set (array) of refractory ceramic bricks for the formation of a vault-like (arch-like) support structure.

Such support structures can primarily be found in industrial furnaces, wherein the state of the art as well as the invention is further explained with the help of an arch in the burner area of a lime shaft kiln, without limiting the inventive concept.

A vault-like support structure according to DE 39 33 744 C2 is located in the burner area of a lime shaft kiln. According to FIG. 1, it consists of—in a frontal view (hereafter simplified as: in the Y-direction of the coordinate system)—multiple (hereafter simplified as: in the Z-direction of the coordinate system) stacked, vault-like rows of bricks 14,16, arranged one on top of the other, wherein each row of bricks consists of multiple adjacent (hereafter simplified as: in the X-direction of the coordinate system) bricks. In the following, the orientation using the coordinate system (X, Y, Z) is analogously adapted for the individual brick of the support structure.

The bricks arranged adjacent to each other in the X-direction are form fitted with radially, so in the Z-direction, extending tongues and grooves (male and female profiles). A specially formed end-brick-set is inserted centrally in the Y-direction between two oppositely extending segments of a row of bricks in order to close it.

This system has been proven advantageous, but requires significant assembly work. This is analogously valid for the system according to EP1255088B1, according to which all bricks of a row of bricks are also connected via radially extending tongues and grooves, but differently to DE 39 33 744 C2 in a single direction.

The object of the invention is to provide an alternative method for the laying of the bricks which particularly also allows for a simple and safe assembly in the assembled brick system.

The invention is based on the following finding: The form fitted connection via radial grooves and radial tongues makes the laying of the bricks in a back-to-back manner (in the Y-direction) difficult to impossible. The radially orientated connection elements also lead to the issue that often only an uneven force fitting is achieved in the 3 directions of the coordinate system.

In order to overcome these disadvantages the invention suggests designing the bricks with two form-fitting elements in the X and the Y-direction, which simultaneously stabilize the bond/assembly in the Z-direction. Hence the bricks can easily be arranged in a continuous assembly/set in the X and Y-direction, but also in the Z-direction of the coordinate system.

The connection of adjacent bricks occurs, as previously, via corresponding profiles on the outer surfaces of the bricks, but according to the invention in the X- and Y-direction, whereby, for the first time ever, it is possible to arrange all bricks within one layer (abreast in the X-direction, back-to-back in the Y-direction) in a form-fitted manner to form a support structure. This results directly in a stabilization of the entire brick arrangement/support structure.

In its most general embodiment, the invention relates to a set (compound system) of bricks, which are arranged abreast, in the X-direction, and back-to-back, in the Y-direction in rows running perpendicular to each other so that collectively they form a vault-like support structure, wherein more than 90% of the bricks feature the following shape:

An inner side and an outer side in the X-direction, a front side and a back side in the Y-direction and an upper side and a lower side in the Z-direction, The front side and the back side feature corresponding profiles, which result in a form fitting between a back side of a brick and a front side, following in the Y-direction, of an adjacent brick.

The inner side and the outer side feature corresponding profiles, which result in a form fitting between an outer side of a brick and an inner side, following in the X-direction, of an adjacent brick.

According to the invention the majority of the bricks within the bridge-like support structure should consist of identical bricks. Other brick formats and/or geometries should be limited to the structurally essential areas, for example the bearings at the ends of an arch. In support structures with oppositely extending arch sections, similarly as described in the DE 39 33 744 C2, a correspondingly adapted end-brick-set, which consists of bricks of other formats, can be inserted in the middle, if necessary.

Generally more than 95% of the bricks of the brick system can be designed in the manner according to the invention.

The mentioned profiles each extend in one direction of the coordinate system (X, Y) between opposite sides/edges of the brick, which means that they are no discrete profiles which protrude centrally from the surface or extend centrally in the surface.

According to one embodiment at least one profile of a brick is designed as a type of tongue (male), while the corresponding profile of the brick (on its opposite surface) is designed as a type of corresponding groove (female). Correspondingly the tongue and groove extend once again across the entire distance between opposite edges of the brick.

The tongue and groove of the brick can be arranged off-centre in the Z-direction. According to one embodiment the groove and tongue are closer to the lower side of the brick than to the upper side.

The size of the grooves and tongues is generally not crucial. The groove and tongue should however have a minimum size in order to ensure the mechanical stability of the form fit connection even over longer periods of time. Therefore one embodiment suggests that the groove and the tongue of the bricks in the Z-direction extend across/along at least 20% of the height of the brick in the Z-direction.

A different type of profile is a step, wherein the corresponding profile of the brick (on the opposite surface) consists of a corresponding step, so that the desired form-fitting can be achieved again between adjacent bricks.

The steps can again be arranged off-centre in the Z-direction of the brick, for example closer to the upper side of the brick than to the lower side, while they extend across the entire distance between opposite edges/sides of the brick in the X or Y-direction.

In order to avoid notching effects it is suggested to design the profiles on the inside and the outside as well as the front side and the back side of the brick at least partially at an angle that is not 90° to the respective side of the brick.

In order to achieve a secure form fitting across the entire brick system (set) depending on the curvature of the vault, one embodiment suggests that the bricks are getting slimmer (are tapered) from the top to bottom (in the Z-direction). Respectively this results in a wedge-shape towards the lower side of the brick on the front side and back side of the brick. Such a "wedge shape" is generally known, but for bricks of other geometrical shapes.

A further embodiment suggests that the profiles on the front side and back side of a brick are offset in the Z-direction compared to the profiles on the inner and outer sides of the brick. This "offset" arrangement of the bidirectional profiles improves the homogeneity of the load distribution in the mounted state.

This is also valid if the steps of the brick extend above the grooves/tongues of the brick in the Z-direction.

Within a row of bricks (in the X-direction), bricks can be arranged in the same direction or in two segments running in opposite directions.

Further characteristics of the invention are revealed in the characteristics of the sub-claims as well as the other application documents.

This includes arranging the bricks of adjacent rows offset in the Y-direction.

In the following, the invention is further described with the aid of the attached drawings. It is shown—each in a schematic view—

FIG. 1: a perspective view of a brick designed according to the invention

FIG. 2*a*: a frontal view of the back side RP(N) in the Y-direction of the brick according to FIG. 1

FIG. 2*b*: a side view in the X-direction of the brick according to FIG. 1

FIG. 3: a view in the Y-direction of a vault-like support structure with bricks according to FIG. 1

Figure 4:
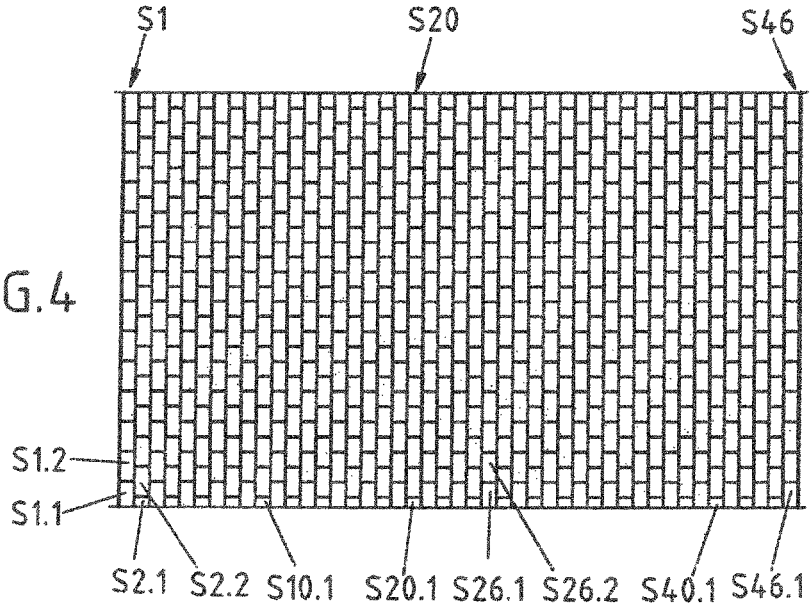

FIG. 4: a view in the Z-direction from below of the support structure according to FIG. 3

Figure 5:
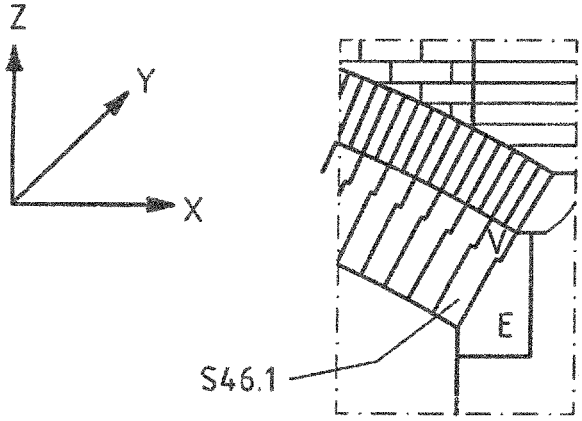

FIG. 5: an enlarged view of the right end of the support arch according to FIG. 3

In the FIGS. 2*a* and 4-5, an X,Y,Z coordinate plane is schematically displayed.

The brick displayed in FIG. 1 features an inner side I, an outer side A, a front side V, a back side R, an upper side O and a lower side U.

The front side V and the back side R feature corresponding profiles VP, RP, namely with a groove N on the back side R and a corresponding tongue F on the front side, each of which extends across the entire width of the brick (=distance between the inner side I and the outer side A).

A profile IP can be recognized as a step ST1 on the inner side I, and a corresponding step ST2 is provided as a profile AP on the opposite outer side A, wherein the profiles IP, AP extend across the entire length of the brick, thus between the opposite edges K1, K2 of the brick.

Form fitted connections can be created between the bidirectional profiles VP, RP; IP, AP so that identical bricks located/arranged beside each other, or rather behind each other, interlock in a form fitted manner as displayed in FIGS. 3 to 5.

46 rows of bricks S1 . . . S46, which are arranged abreast in the X-direction and which consist of bricks S1.1, S1.2 . . . S26.1, S26.2 . . . which are arranged in a back-to-back manner in the Y-direction, can be seen schematically. Bricks S1.1, S2.1 of adjacent rows (S1, S2) are arranged offset in the Y direction.

In other words: The bricks of adjacent rows of bricks S1 . . . S46 are connected in a form fitted manner via the steps ST1, ST2, while the bricks of an individual row of bricks, for example S2, feature a form-fit via the groove/tongue connections N,F back-to-back (one after the other) in the Y-direction.

Overall the bricks slightly narrow between the upper side O and the lower side U, so that the vault-like support structure according to FIG. 3 can be constructed in a form-fitted manner.

At the ends, the vault-like support structure rests on end bricks E which are not further described.

The support structure can be accommodated in the X and Y-direction in the assembled set of the described bricks.

In one embodiment with oppositely extending segments of the support arch (FIG. 3), a special end-brick-set SCH can be built into the centre, as it is generally know from the DE 39 33 744 C2.

Overall, a high mechanical stability of the support arch as well as an advantageous force/load distribution in the brick system is achieved by the form fitted connection of the bricks laid abreast and back-to-back.

The invention claimed is:

1. A refractory brick, wherein said refractory brick has the following shape: a) an inner side (I), an outer side (A), a front side (V), a back side (R), an upper side (O) and a lower side (U), b) the front side (V) and the back side (R) feature corresponding profiles (VP, RP), which result in a form fit between the back side (R) of said refractory brick (S 1.1) and a front side (V) of an adjacent refractory brick (S1.2), c) the inner side (I) and the outer side (A) feature corresponding profiles (IP, AP), which result in a form fit between the outer side (A) of said refractory brick (S1.1) and an inner side (I) of an adjacent refractory brick (S2.1), d) and wherein said profiles (VP, AP) of said refractory brick (S1.1) are designed as steps extending horizontally across the entire distance between opposite sides of said refractory brick (S1.1.) and the corresponding profiles (RP, IP) of said refractory brick (S1.1) are designed to accommodate the steps of adjacent refractory bricks (S2.1) when assembled.

2. The refractory brick according to claim 1, wherein at least one profile (VP, RP, IP, AP) of said refractory brick includes brick is designed as a tongue (F) and the corresponding profile (RP, VP, AP, IP) of said refractory brick includes as a corresponding groove (N).

3. The refractory brick according to claim 2, wherein the tongue (F) and the groove (N) of the brick are arranged off-centre in a Z-direction closer to the lower side (U) of the brick.

4. The refractory brick according to claim 2, wherein the tongue (F) and the groove (N) of the bricks extend across at least 20% of the height of the brick in a Z-direction.

5. The refractory brick according to claim 4, wherein the steps are arranged off-centre in the Z-direction closer to the upper side (O) of the brick.

6. The refractory brick according to claim 1, wherein the tongue (F) and the groove (N) feature their longest extension in a Z-direction.

7. The refractory brick according to claim 6, wherein the steps of the brick extend, in the Z-direction, above the tongues/grooves (F, N) of the brick.

8. The refractory brick according to claim 1, wherein the profiles (IP, AP, VP, RP) on the inner side (I) and the outer side (A) as well as on the front side (V) and the back side (R) of the brick run at least partially at an angle that is not 90° to the corresponding side of the brick (I, A, V, R).

9. The refractory brick according to claim 1, wherein the bricks are designed wedge-shaped and tapered towards the lower side (U).

10. The refractory brick according to claim 1, where the profiles (VP, RP) on the front and back side (V, R) of the brick run offset in the Z-direction to the profiles (IP, AP) on the inner and outer side (I, A) of the brick, seen in a Z-direction of the brick.

11. Assembly according to claim 1, consisting of two segments which are running in opposite directions in the X-direction.

12. Assembly according to claim 1, wherein bricks running abreast in the X-direction (S1.1, S2.1) run offset in the Y-direction.

* * * * *